US005176093A

United States Patent [19]

Binversie et al.

[11] Patent Number: 5,176,093

[45] Date of Patent: Jan. 5, 1993

[54] MARINE PROPULSION DEVICE

[75] Inventors: Gregory J. Binversie, Grayslake; John M. Daniels, Round Lake Park, both of Ill.

[73] Assignee: Outboard Marine Corporation, Waukegan, Ill.

[21] Appl. No.: 701,618

[22] Filed: May 14, 1991

Related U.S. Application Data

[63] Continuation of Ser. No. 451,629, Dec. 18, 1989, abandoned.

[51] Int. Cl.[5] ..... B63H 21/26

[52] U.S. Cl. ..... 114/61; 440/53

[58] Field of Search ..... 440/61, 53, 56

[56] References Cited

U.S. PATENT DOCUMENTS

| | | | |
|---|---|---|---|
| 3,983,835 | 10/1976 | Hall | 440/61 |
| 4,391,592 | 7/1983 | Hundertmark | 440/61 |
| 4,498,871 | 2/1985 | Hall et al. | 440/61 |
| 4,551,105 | 11/1985 | Hall | 440/61 |
| 4,695,260 | 9/1987 | Suzuki | 440/61 |
| 4,702,714 | 10/1987 | Nakase | 440/61 |
| 4,909,766 | 3/1990 | Taguchi | 440/61 |
| 4,990,111 | 2/1991 | Saitoh et al. | 440/61 |

FOREIGN PATENT DOCUMENTS

| | | | |
|---|---|---|---|
| 171791 | 9/1984 | Japan | 440/61 |
| 221994 | 9/1987 | Japan | 440/61 |

*Primary Examiner*—Sherman Basinger
*Assistant Examiner*—Thomas J. Brahan
*Attorney, Agent, or Firm*—Michael, Best & Friedrich

[57] ABSTRACT

A marine propulsion device includes a support adapted to be attached to a boat hull and a propulsion assembly including a propeller adapted to be driven by an engine. The propulsion assembly is connected to the support for vertical pivotal movement relative thereto and a hydraulic tilt cylinder and piston assembly is connected at one end to the support and has a second end connected to the propulsion assembly. The piston is movable toward the other end of the cylinder when the one end is pressurized to tilt the propulsion assembly upwardly. At least one trim cylinder is fixed relative to the support and includes a trim piston reciprocally mounted on the cylinder and releasably engageable with the propulsion assembly. Actuation of the propeller while the propulsion assembly is tilted upwardly is operative to force the propulsion assembly downwardly against the piston. A valve is operable when the piston is forced toward the one end of the cylinder to vent hydraulic fluid from the one end of the cylinder and an orifice is provided for controlling the flow rate of fluid through the valve to prevent the rapid descent of the propulsion assembly.

4 Claims, 1 Drawing Sheet

MARINE PROPULSION DEVICE

This application is a Continuation of Ser. No. 451,629 filed Dec. 18, 1989, now abandoned.

BACKGROUND OF THE INVENTION

This invention relates to marine propulsion devices and more particularly to the tilt and trim systems for such devices.

Marine propulsion devices, such as outboard motors, generally include a hydraulic tilt system for trimming and tilting the propulsion device upwardly about a transverse axis to permit the device to be operated in shallow or vegetation-filled water. Toward this end, the propulsion device is pivotally mounted on a bracket secured to the transom of the boat to be driven. The hydraulic tilt system generally includes a tilt cylinder pivotally connected to the propulsion device and the bracket for pivoting the propulsion device upwardly and one or more relatively short trim cylinders mounted on the bracket and engageable with the motor for tilting the propulsion device through relatively small angles.

The hydraulic trim and tilt cylinders are generally pressurized by a single pump. Initially, both the trim and tilt cylinders are active to trim the propulsion unit through a relatively small angle. After the trim cylinders have reached the end of their stroke, further pivotal movement is under the operation of the tilt cylinder.

When the propulsion device is pivoted upwardly at a relatively high angle, the engine is normally run at idle or a relatively slow speed. However, should the throttle be engaged inadvertently so that the engine begins operating at a high speed, considerable torque will be exerted on the propulsion device, tending to pivot the same downwardly. In order to prevent damage to the hydraulic system, a relief valve is provided which permits the propulsion device to pivot downwardly in the event this thrust-induced pressure exceeds some predetermined value. Under such circumstances, the propulsion device may pivot downwardly at such a rapid rate that the trim cylinders are damaged.

SUMMARY OF THE INVENTION

It is an object of the invention to provide a new and improved tilt and trim system for marine propulsion devices.

A further object of the invention is to provide a trim and tilt system for marine propulsion devices which prevents the rapid descent of the device should the device be throttled up while in a tilted position.

A still further object of the invention is to provide a marine propulsion device with means for protecting the trim cylinders from damage which would otherwise occur as the result of rapid descent from an elevated position.

These and other objects and advantages of the present invention will become more apparent from the detailed description thereof taken with the accompanying drawings.

In general terms, the invention comprises a marine propulsion device including first means adapted to be attached to a boat hull and a propulsion assembly having a propeller adapted to be driven by an engine. The propulsion assembly is connected to the first means for vertical pivotal movement relative thereto. A hydraulic tilt cylinder and piston assembly has one end connected to the first means and a second end connected to the propulsion assembly, the tilt cylinder being operative to move the piston toward the other end when the one end is pressurized to tilt the propulsion assembly upwardly. Actuation of the propeller while the propulsion assembly is tilted upwardly is operative to force the propulsion device against the piston A valve means is operable when the piston is forced toward the one end of the cylinder to vent hydraulic fluid from the one end of the cylinder and control means are provided for controlling the flow rate of fluid through the valve means to prevent the rapid descent of the propulsion assembly.

DETAILED DESCRIPTION OF THE PREFERRED EMBODIMENT

Figure 1:
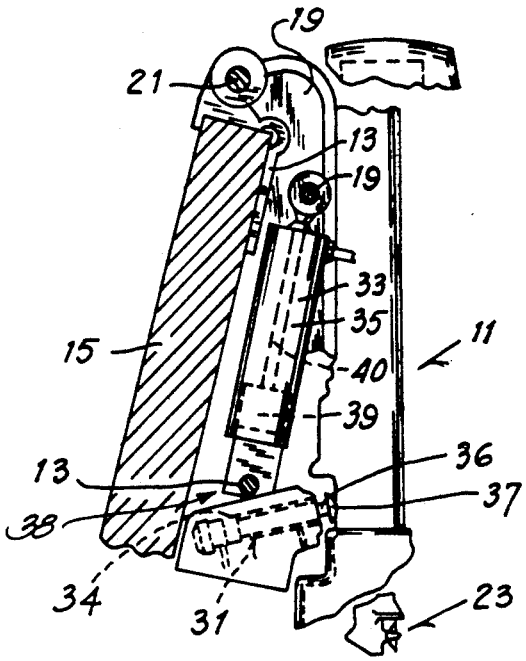
FIG. 1 is a side elevational view, partly in section, of a portion of a marine propulsion device incorporating the present invention.

FIG. 1 schematically illustrates a marine propulsion device in the form of an outboard motor 11 which includes a mounting bracket 13 adapted to be attached in any suitable manner to the transom or hull of a boat 15. The motor 11 may be pivotally connected to the bracket 13 in any suitable manner, such as, by means of a swivel bracket 19 which is connected to the motor 11 and which is pivotally connected to the mounting bracket 13 by a generally horizontally extending tilt pin 21. A trim and tilt system 22 is operative to pivot the motor 11 about the pin 21 as will be described in greater detail below. It will be appreciated by those skilled in the art that the propulsion device also includes an internal combustion engine (not shown) which is coupled by a shaft and drive train (not shown) to a rotatably mounted propeller 23.

The trim and tilt system 22 includes one or more trim cylinders 31 and one or more tilt cylinders 33. The trim cylinders 31 are fixedly mounted at one end on the mounting bracket 13 and each includes a piston 34 movable therein and connected to a stem 36 having a rounded head 37 for bearing against the lower end of the swivel bracket 19. It will be appreciated that when the tilt cylinders 33 are pressurized at their lower ends 38, the propulsion device 11 will be tilted upwardly about tilt pin 21.

The tilt cylinder 33 is pivotally connected at its lower end to the mounting bracket 13 and at its upper end to the swivel bracket 19 so that pressurization of the tilt cylinder will cause the propulsion device 11 to tilt upwardly and in a counterclockwise direction as viewed in FIG. 1. It will be appreciated that because the stroke of the tilt cylinder 33 exceeds that of the trim cylinders 31, both the trim and tilt cylinders will be employed when the propulsion device is being trimmed. On the other hand, when the trim cylinders have reached the maximum extent of their stroke, further pivotal movement will be under the operation of the tilt cylinder 33.

The tilt cylinder 33 also includes a piston 39 having a stem 40 which is pivotally connected at its upper end to the swivel bracket 19. It will be appreciated that when the lower end 42 of the cylinder 33 is pressurized, the piston 39 will move toward the other end 43 of cylinder 33 whereby the propulsion device 11 will be pivoted in a counterclockwise direction about swivel bracket 19 as shown in FIG. 1 while pressurization of the other end 43 will pivot the propulsion device in the opposite direction.

A one-way valve 45 located in the piston 39 prevents fluid flow from the lower end of cylinder 42 to the upper end 43, but permits flow in the opposite direction. While the valve 45 may take any conventional form, in the illustrated embodiment it comprises a spring biased ball check valve. Valve 45 permits the tilt cylinder 33 to extend rapidly as fluid flows from the upper end 43 to the lower end 42 in the event the propulsion device 11 impacts an underwater obstacle. The bias on the valve 45 is relatively high, for example, about 2500 lbs./sq. in.

Figure 2:
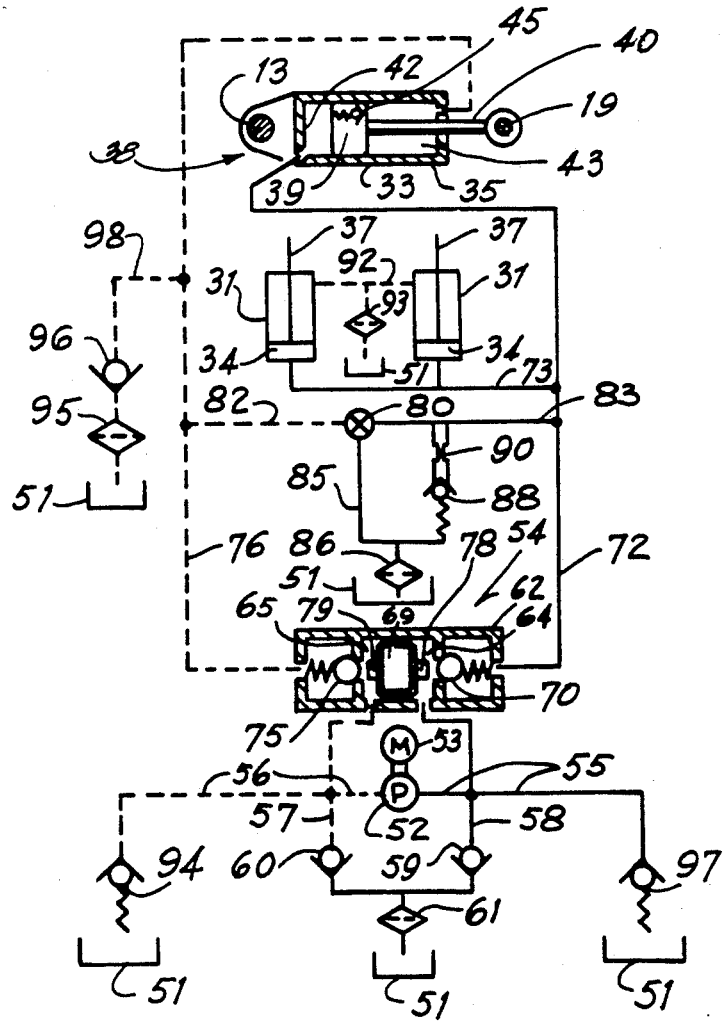
FIG. 2 schematically illustrates the hydraulic system according to the preferred embodiment of the invention and employed in the marine propulsion device shown in FIG. 1.

Reference is now made to FIG. 2, which schematically illustrates the hydraulic assembly in accordance with the preferred embodiment of the invention. In particular, the hydraulic assembly includes pressure fluid supply and control means for selectively supplying the trim and tilt cylinders 31 and 33 with pressure fluid. While various means may be employed, in the illustrated embodiment, the fluid pressure supply and control means comprises a reservoir or sump 51, a pump 52, driven by a reversible motor 53 and connected to sump 51, a control cylinder or valve 54 connected to pump 52, and fluid duct coupling the control valve 54 with the tilt and trim cylinders 31 and 33 and the pump 52. The pump 52 may be reversibly driven by motor 53 and includes a first fluid connection or ducts 55 for supplying pressure fluid when the pump 52 is rotating in one direction and a second duct 56 for supplying pressure fluid when pump 52 is rotated in the opposite direction. The ducts 55 and 56 also are respectively connected through conduits 57 and 58 with reservoir 51. In addition, the conduits 57 and 58 include one-way valves 59 and 60, respectively, which permit flow to the pump 52 and prevent flow from the pump to the reservoir 51. Preferably, the conduits 58 and 59 communicate with the sump or reservoir 51 through a common filter 61.

The control valve 54 includes a housing or cylinder 62 which has opposing first and second ends 64 and 65 which respectively communicate with the ducts 58 and 59. Disposed within the housing 62 is a control piston 66 which is mounted for movement from a center position toward the end 65 when the first end of the cylinder 64 is pressurized from conduit 58. Conversely, when the end 65 of cylinder 62 is pressurized through conduit 57, piston 69 will move toward the end 64 of cylinder 62.

Communicating with the first end 64 of cylinder 62 is a spring biased, normally closed valve 70 which also communicates through conduits 72 and 73, respectively, with the lower ends of the trim cylinders 31 and the end 42 of tilt cylinder 33. A second spring biased, normally closed valve 75 communicates with the end 65 of cylinder 62 and through conduit 75 to the upper end 43 of tilt cylinder 33. While any suitable valves may be employed, ball check valves are shown for purposes of illustration.

Any suitable means, such as stems 78 and 79, which extend coaxially from the opposite ends of piston 69, are provided for respectively opening ball valves 70 and 75 upon movement of the piston 69 into the ends 64 or 65 of cylinder 62. In particular, when the first end 64 of cylinder 62 is pressurized, the piston 69 will move toward the second end 65, whereby stem 79 will move ball valve 75 off of its seat to communicate conduits 76 and 57. In addition, the pressure in cylinder end 64 will move ball valve 70 off of its seat and against its biasing spring, thereby communicating conduits 58 and 72. Conversely, when the end 65 of cylinder 62 is pressurized, piston 69 will move to the end 64 of cylinder 62 so that stem 78 will move valve 70 from its seat, while the pressure will move valve 75 from its seat and against its biasing spring.

A manual release valve 80 is interposed between conduits 82 and 83, which are connected between conduits 76 and 72. Valve 80 has a closed position, a first open position which connects conduits 82 and 83 to each other, and a third position which connects conduits 82 and 83 to sump 51 through conduit 85 and filter 86. Also connected between conduit 83 and sump 51 is the series combination of a shallow water drive valve 88 and an orifice 90.

When the motor 53 is at rest and the pump 52 is not operating, the piston 69 is locked in a position intermediate the ends of cylinder 62 and the valves 70 and 75 are biased into a closed position by their respective springs. Assuming that the manual release valve 80 is also closed, fluid flow in either direction is prevented and the trim cylinders 31 and the tilt cylinder 33 are maintained in position.

Assume for purposes of illustration that the trim cylinders 31 and the tilt cylinder 33 are in their retracted conditions and the marine propulsion device 11 is untilted. If it is desired to upwardly tilt the marine propulsion device 11, the motor 53 is actuated to drive pump 52 in a forward direction thereby providing fluid under pressure through conduits 55 and 58 to the end 64 of cylinder 62. This moves the valve 70 from its seat thereby providing fluid under pressure to conduit 72, which is connected to the lower ends of the trim cylinders 31 and the lower end 42 of tilt cylinder 33. As a result, each of the trim cylinders 31 and the tilt cylinder 33 are extended so that the marine propulsion device 11 begins to pivot counterclockwise as shown in FIG. 1. Pressurization of the end 64 of cylinder 62 will also cause piston 69 to move toward the end 65 of cylinder 62 so that stem 79 moves valve 75 from its seat. This permits return fluid flow from the end 43 of tilt cylinder 33 to the intake of pump 52 through conduits 75 and 56. Fluid flow from the upper end of trim cylinders 31 flows to sump 51 through conduit 92 and filter 93.

If it is desired to trim the propulsion device 11, the motor and pump are stopped before the trim cylinders 31 reach the end of their stroke. This causes a decrease in fluid pressure within the end 64 of cylinder 62 which permits the piston 69 to return to its neutral position and the valves 70 and 75 to close under the influence of their respective biasing springs. The propulsion device 11 will be supported in its trim position by the trim cylinders 31 and the tilt cylinder 33.

On the other hand, if it is desired to move the propulsion device 11 into a tilt position beyond the stroke of the trim cylinders 31, operation of the pump 52 is continued so that the trim cylinders 31 reach the end of their stroke and continued movement of the piston 39 will tilt the propulsion device 11 into a higher tilt angle. After the piston 39 reaches the end of its stroke, a pressure relief valve 97 connected between conduit 55 and sump 51 will open to connect the pump 52 to the sump 51 and thereby prevent damage to the cylinder 33 or the hydraulic system. The pump 52 is then deactivated so that the valves 70 and 75 close and the piston 69 returns to its neutral position. The cylinder 33 will then support the propulsion device 11 in its tilted position.

When it is desired to lower the propulsion device 11 from its tilted position, the motor 53 and the pump 52 are operated in the reverse direction, thereby pressurizing the end 65 of cylinder 62. This moves the valve 75 from its seat so that hydraulic fluid under pressure is provided to the upper end 43 of tilt cylinder 33 through conduits 57 and 76. In addition, piston 69 moves toward the end 64 of cylinder 62, thereby moving valve 70 from its seat so that hydraulic fluid can flow from the lower end 42 of tilt cylinder 33 to the opposite side of the pump 52. When the piston 39 reaches the end of its stroke, a second pressure relief valve 94, which is connected between conduit 57 and sump 51, will open to prevent damage to the system as the pump 40 continues to operate.

Normally, when the propulsion device 11 is in its tilted position, the engine is idled or operated at a very low speed. However, should the throttle be moved, causing the engine to operate at a much higher speed, the action of the propeller 33 will tend to pivot the propulsion device downwardly and in the clockwise direction as viewed in FIG. 1. Fluid flows from the lower end 42 of tilt cylinder 33 through pressure relief valve 88. In prior art systems, this descent occurred quite rapidly and tended to damage the trim cylinders 31. A flow restricting orifice 90 according to the invention limits the rate of descent in the event the engine throttle is actuated, so that the trim cylinders 33 are not damaged.

Because the pump is not operating when the piston 39 descends as a result of the engine being operated, fluid is drawn to the upper end of the cylinder from sump 51 through filter 95, check valve 96, and conduit 98.

While only a single embodiment of the invention has been illustrated and described, those skilled in the art will appreciate that the invention is not limited to the details set forth in the description of the preferred embodiment and illustrated in the drawings and that the invention may be practiced by the use of other embodiments as well.

Accordingly, it is not intended that the invention be limited to the embodiment illustrated and described, but only by the scope of the appended claims.

We claim:

1. A marine propulsion device including first means adapted to be attached to a boat hull, and a propulsion assembly including a propeller adapted to be driven, said assembly being connected to said first means for vertical, pivotal movement relative thereto, a hydraulic tilt cylinder and piston assembly having one end connected to said first means and a second end connected to said propulsion assembly, a hydraulic fluid reservoir, hydraulic fluid pressure supply and control means connected to said reservoir and to one of said first and second ends of said tilt cylinder and piston assembly for pressurizing the same to effect extension of said tilt cylinder and piston assembly and to thereby tilt said propulsion assembly upwardly, said propeller operating, when said propulsion assembly is in an upwardly tilted position, to tend to contract said tilt cylinder and piston assembly so as to displace said propulsion assembly downwardly, a conduit communicating between said one end of said tilt cylinder and piston assembly and said reservoir, pressure relief valve means located in said conduit for venting hydraulic fluid from said one end of said tilt cylinder and piston assembly to said reservoir, and a restricted orifice separate from said valve means and located in said conduit for controlling the rate of hydraulic fluid flow through said conduit when said pressure relief valve means is open.

2. A marine propulsion device set forth in claim 1 wherein said tilt cylinder and piston assembly includes a tilt cylinder and a tilt piston, and further including at least one trim cylinder fixed relative to one of said first means and said propulsion assembly and connected to said fluid pressure supply and control means and to said conduit, and including a trim cylinder, a trim piston reciprocally mounted in said trim cylinder and being releasably engageable with the other of said first means and said propulsion assembly, and a trim piston rod fixed to said trim piston, the stroke of said trim piston being shorter than the stroke of said tilt piston, whereby pressurization of said tilt and trim cylinders by said hydraulic fluid pressure supply and control means will tilt said propulsion assembly out of engagement with said trim piston rod, said orifice limiting the rate of descent of said propulsion assembly to prevent damage to said trim piston rod.

3. A marine propulsion device as set forth in claim 1 wherein said fluid supply and control means includes pump means operable to supply hydraulic fluid under pressure to said one end of said tilt cylinder and piston assembly and additional valve means preventing the flow of hydraulic fluid from said tilt cylinder and piston assembly to said pump means when said pump means is not operating.

4. A marine propulsion device as set forth in claim 1 wherein said valve means vents only in response to high propeller thrust.

* * * * *